United States Patent [19]

Tsuchinari et al.

[11] Patent Number: 4,676,412

[45] Date of Patent: Jun. 30, 1987

[54] REFRACTORY NOZZLES USED AROUND LADLE AND TUNDISH

[75] Inventors: Akihiro Tsuchinari, Himeji; Osamu Shimobayashi; Hisahiro Hattori, both of Ako, all of Japan

[73] Assignee: Harima Refractories Co., Ltd., Takasago, Japan

[21] Appl. No.: 779,030

[22] Filed: Sep. 23, 1985

[51] Int. Cl.[4] ..... B22D 41/08

[52] U.S. Cl. ..... 222/591; 501/100; 264/117

[58] Field of Search ..... 222/591, 606, 607; 264/117; 164/337; 501/100; 23/313 R

[56] References Cited

U.S. PATENT DOCUMENTS

| | | | |
|---|---|---|---|
| 3,264,069 | 8/1966 | Getty | 23/313 R |
| 3,317,277 | 5/1967 | Cosgrove | 23/313 R X |
| 3,368,004 | 2/1968 | Sirianni et al. | 23/313 R |
| 3,558,758 | 1/1971 | Wendt et al. | 23/313 R X |
| 4,066,467 | 1/1978 | Rechter | 501/100 |
| 4,427,068 | 1/1984 | Fitzgibbon | 264/117 X |
| 4,440,866 | 4/1984 | Lunghofer et al. | 264/117 X |

FOREIGN PATENT DOCUMENTS

| | | | |
|---|---|---|---|
| 47-49409 | 12/1972 | Japan . | |
| 42573 | 3/1982 | Japan | 222/591 |

*Primary Examiner*—Joseph J. Rolla
*Assistant Examiner*—Nils E. Pedersen
*Attorney, Agent, or Firm*—Sandler & Greenblum

[57] ABSTRACT

Refractory nozzles including a so-called long nozzle, an upper nozzle, a lower nozzle, and an immersion nozzle made from high-alumina refractory material, graphite powder, silica powder and other minor constitutents wherein a major part of the high-alumina refractory material is thermospherized particles of about 0.3 to 3.0 mm in diameter which have good spalling and corrosion resistance. Revolving and rolling ability of the thermospherized particles gives far-reaching capability of pressing force deep into the nozzle center portion during shape-forming by a compaction press. Hence more uniform products can be obtained, and a less expensive unidirectional compaction process can be used instead of a high cost isostatic process for compaction.

11 Claims, 3 Drawing Figures

REFRACTORY NOZZLES USED AROUND LADLE AND TUNDISH

FIELD OF INVENTION AND RELATED ART

This invention relates to nozzles used around the ladle and the tundish in a steel manufacturing plant and made from specially processed refractories, and more particularly, it relates to those used in so-called continuous casting.

The term "nozzles" used herein is intended to include an upper nozzle, a lower nozzle, a long nozzle and an immersion nozzle, all of which are shaped refractories and exposed to serious break emergency. Their relative locations in the plant are exemplarily shown in FIG. 1, wherein ladle 1 receives finished liquid steel from whatever type of furnaces (basic oxygen, open-hearth, or electric), adjusts the temperature of the liquid steel and, if necessary, removes sulfur, oxygen, hydrogen and carbon. The liquid steel then flows down from stopper rod assembly 2 through long nozzle 3 to tundish 4 which functions to calm down the flow of liquid steel. From tundish 4, the liquid steel falls down through upper nozzle 5 slide gate 6, lower nozzle 7 and immersion nozzle 8 to mold 9. The nozzles must have enough mechanical and chemical stability by themselves against the downflowing liquid steel.

The terms "thermospherize", "thermospherized" and the like used herein mean "size-enlrge fine powder to spheres or balls and heat-harden thereafter", the adjective form thereof and the like derivative forms. A tumbling process using a so-called inclined pan or rotary drum agglomerator is suitable for size enlargement, while heat-hardening can be made by traveling grate, rotary kiln or shaft furnace.

High-alumina refractory materials usually contain 100% to just above 45% alumina. The desired alumina content is obtained by adding bauxites, synthetic aluminosilicates, and synthetic aluminas to clay.

The usual process of manufacturing refractories includes, as well known, grinding, mixing, molding, drying and burning.

Japanese Pat. No. 955778 discloses refractory nozzles containing 42 to 93% by weight alumina powder, 4 to 44% by weight graphite powder and 2 to 23% by weight silica powder. They are thoroughly kneaded with some binder added and formed into shape by means of an isostatic press known as a rubber press. The rubber press gives a highly uniform product, but the production rate is considerably low and necessitates subsequent processing in order to adjust shape. Use of unidirectional presses such as a mechanical press and a hydraulic press is desirable but not successful, since the unidirectional pressure force can not reach satisfactorily the central portion of the nozzles in the direction of the force.

Apart from the composition and processing problems, the shape of the refractory particles, especially the uniformity of sphericity of the particles, seems to contribute far-reaching capability of the pressure force. However, none has been reported heretofore to our best knowledge.

BRIEF SUMMARY OF THE INVENTION

It is accordingly an object of this invention to provide refractory nozzles having thermospherized particles as a constituent thereof, which give improved force transmittance.

Another object of this invention is to provide refractory nozzles having good spalling and corrosion resisting properties.

A further object of this invention is to provide nozzles giving good performance and which are made by usual unidirectional presses without resorting to an isostatic press.

In brief, this invention contemplates refractory nozzles containing thermospherized particles as a constituent thereof. Heat treatment of the particles is necessary to give compressive strength thereto. The properties of the thermospherized particles should be: 0.3 to 3.0 mm in diameter; greater than 10 kgf in particle compressive strength; greater than 81% $Al_2O_3$ content; less than 19% silica content.

In addition, the nozzles contain 5 to 20% graphite powder, 3 to 15% silicon powder, and such minor constituents as fine alumina, silicon, aluminum, silicon carbide, if necessary.

Addition of heat-hardened, or non-heat-hardened non-spherical, high-alumina material in lesser amounts is permissible.

DETAILED DESCRIPTION OF THE PREFERRED EMBODIMENTS

1. Thermospherization

Thermospherization is applied only for high-alumina material. First, fireclay and alumina (bauxite, diaspore) or alumina-rich aluminosilicates are mixed to give the desired composition. The mixture is then ground to powder of less than about 50 μm in diameter. The powder in turn is treated by a tumbling agglomerator exemplified by an inclined disc with addition of some binder. Powder greater than 50 μm in diameter is not desirable since the inclusion thereof gives poorer particles in agglomeration.

Figure 1:
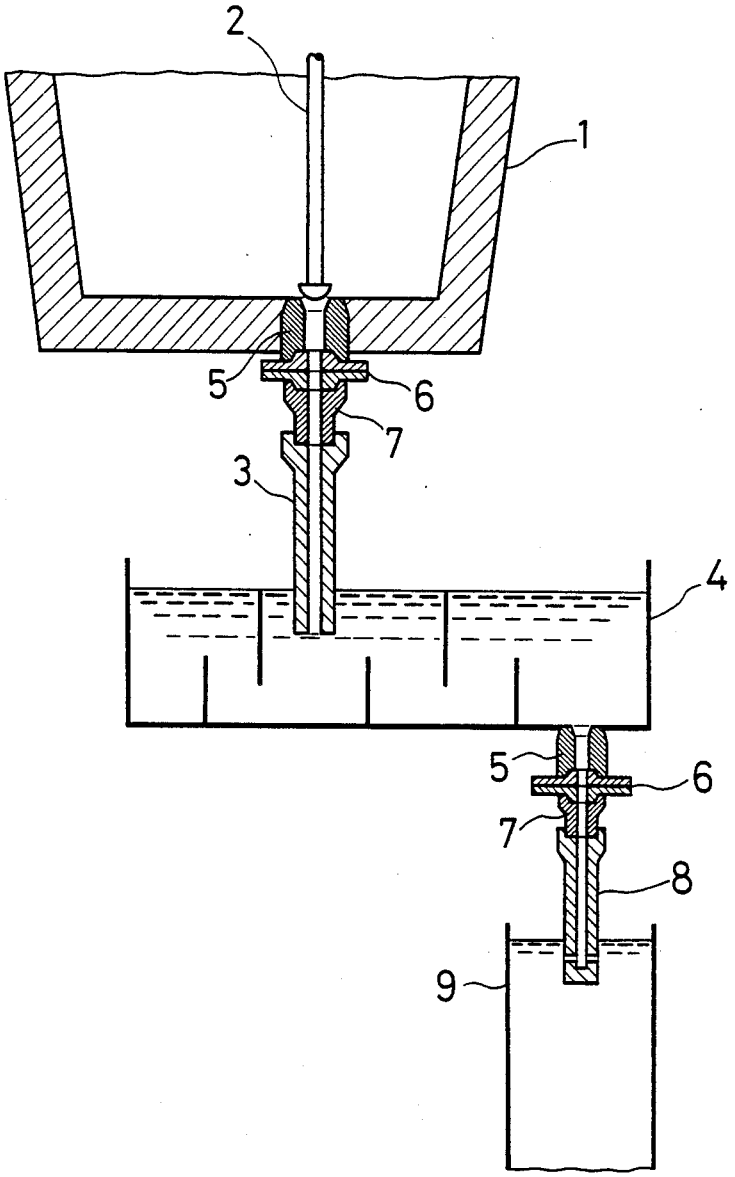
FIG. 1 is a schematic representation of liquid steel processing apparatus to designate relative positions of the nozzles.
Figure 2:
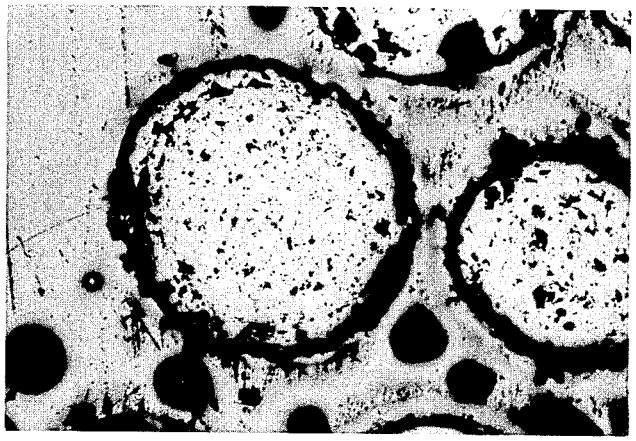
FIGS. 2 and 3 are microphotographs of 100 magnification showing thermospherized particles and non-spherized, but heat-hardened particles, respectively.
Figure 3:
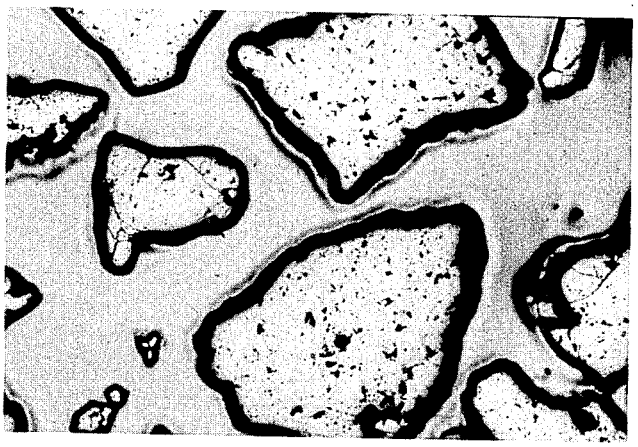

The effect of heat-hardening temperature is shown in Tables 1 and 2 for spherized and non-spherized particles, respectively. For a particle compressive strength of 10 kgf to be attained, a temperature above about 1600° C. is necessary for a heating time of 6 hrs. It will be apparent that the spherized particles have lower sphericity values than non-spherized particles from inspection of the Tables. The external appearance of the spherized and non-spherized particles is shown in FIGS. 2 and 3 as microphotographs of 100 magnification. The properties of thermospherized particles having different chemical compositions heat-hardened at 1750° C. are denoted in Table 3. The alumina content of the thermospherized particles should be above about 81% by weight and the silica content thereof should be below 19% by weight to obtain good thermal and corrosion resistance. Some other parameters designating good thermospherized particles are: about 0.3 to about 3 mm in diameter; less than 1.05 in sphericity value; less than about 35° in incipient free flowing angle, less than 25% in porosity; and particle size distribution expressed by the Andreasen equation $$F=(D/D_{max})^q\times 100$$

wherein

F = Percent undersize from the cut diameter D;

$D_{max}$ = Maximum particle diameter;

q = Exponential parameter indicating mode of distribution and having a value from 0.3 to 0.6;

$D_{max}$ must be less than one tenth of the nozzle thickness.

2. Requirement for the nozzles

It is important to note that the spherical particles of high-alumina are merely a constituent of the nozzles and the composition of the nozzles is different from that of the thermo-spherized high-aluminas. In fact, certain constituents such as graphite powder and silica powder are present in order to improve performance of the nozzles. Addition of graphite in 5% to 20% by weight of the nozzles improves the spalling and corrosion resisting properties of the nozzles. Amounts less than 5% do not provide significant resistance, whereas those in excess of 20% tend to increase thermal conductivity of the nozzles to the extent that blockage of the nozzles might occur due to cooling. Presence of silica powder in the nozzle composition in an amount from 3% to 15% by weight also increases the resistance to spalling and corrosion. Lower amounts do not provide good effect, on the other hand, amounts exceeding 15% incur reduction of the effect.

Known minor additives which improve performance of the nozzles, such as fine alumina, aluminum, silicon, silicon carbide and others can be added without departing from the scope of this invention.

Mixing of the nozzle constituents, thermospherized high-alumina particles, graphite powder silica powder and the minor constituent(s), can be conducted with, for example, the well known Muller mixer. Known binders such as pitch from coal tar or petroleum residue, some organic polymers of natural and synthetic origin, inorganics, such as silicates and aluminates, spent liquor from sulphite pulp making, or molasses should be added.

Shape forming can be made either by unidirectional presses or isostatic presses in the usual way. In fact, one of the most significant advantages is that nozzles having good spalling and corrosion resistance can be made by the use of unidirectional presses, and hence the products are less expensive. Use of isostatic presses of course gives improved resistance against mechanical failure and chemical attack.

Seemingly, this effect results from using thermospherized high-alumina refractory particles in the nozzle composition, which contribute to the far-reaching capability of pressure force during the compaction pressing.

This effect will be seen in the following examples.

3. Examples

In all experiments, a simplified nozzle form consisting of a hollow cylinder, 14 cm and 8.5 cm in outer and inner diameters, respectively, and 80 cm in length is used in order to remove secondary effects due to gradual or sudden change in wall thickness. Three test pieces of 5 cm length, uppermost (shown as upper in Tables 4 through 7), central, and lowermost (shown as lower) are taken from each simplified test piece.

Each test piece is immersed in liquid steel at a temperature of 1650° C. for 30 min. in an induction furnace, and subsequently cooled violently by an electric fan. This heating-cooling process or thermal shock process is repeated until visual crack is observed. The number of repetitions of the thermal shock, or, in short, the number of thermal shocks, is used as an expression for durability of the simplified nozzle.

The thermospherized particles are made by the above-described method, whereas non-spherized particles are made by compressing the high-alumina material at a pressure of 1500 kgf/cm$^2$, heat-treating at 800° C., crushing with a hammer breaker and subsequent screening.

The heat-hardening temperature of both the thermospherized particles and nonspherized but heat-hardened particles is 1750° C.

A Muller mill is used exclusively for mixing and kneading of the nozzle composition, which is shown in the following examples.

Two types of compaction presses are used. One is a unidirectional press called a friction press having a compression force of 750 metric tons, and the other is an isostatic press called a rubber press having a forming pressure of 1200 kgf/cm$^2$.

The shape-formed nozzles are allowed to stand for 24 hrs at room temperature, and dried thereafter at 150° C. for 48 hrs.

The products are the refractory nozzles as shown in the following Examples. The usual processing of such refractories is to burn them at about 1000° C. in the presence of breeze-size coke. However, for the refractory nozzles of the present invention, this treatment rather degrades the products in reducing the number of thermal shocks, and in this sense is not desirable.

However, the addition of this burning process does not depart from the scope of this invention.

EXAMPLE 1

Sixty six % (by weight, the same hereinafter) thermospherized high-alumina refractory material (90% $Al_2O_3$, 5% $SiO_2$; 0.3 to 3.0 mm in diameter), 10% graphite powder (less than 0.71 mm in diameter), 10% silica powder (less than 0.5 mm in diameter), 10% fine alumina (less than 50 μm in diameter), 2% silicon (less than 50 μm in diameter), 2% aluminum (less than 50 μm in diameter) and phenolic resin as binder were used for the nozzle composition. The unidirectional press was used for shape-forming.

REFERENCE EXAMPLE 1

Substantially the same composition and press as in Example 1 were used except the high-alumina material were non-spherized but heat-hardened particles instead of thermospherized particles.

EXAMPLE 2

Substantially the same thermospherized particles as in Example 1 were used, but the isostatic press was used instead of the unidirectional press.

REFERENCE EXAMPLE 2

Substantially the same as in Example 2 except nonspherized but heat-hardened particles were used instead of thermospherized particles.

EXAMPLE 3

Substantially the same as in Example 1 except the composition of high-alumina refractory material was 82% $Al_2O_3$ and 10% $SiO_2$, instead of 90% $Al_2O_3$ and 5% $SiO_2$.

REFERENCE EXAMPLE 3

Substantially the same as in Example 3 except the high-alumina material was non-spherized but heat-hardened particles instead of thermospherized particles.

EXAMPLE 4

Substantially the same as in Example 1 except the high-alumina refractory material consists of 60% thermospherized particles and 6% non-spherized but heat-hardened particles (in total 66%) instead of 66% thermospherized particles.

The results are shown in Tables 4 through 7.

TABLE 1

Effect of heat-hardening temperature on the thermo-spherized particles (high-alumina refractory material containing 90% $Al_2O_3$ and 5% $SiO_2$: diameter of particles 1.0 to 1.17 mm)

| Heat-hardening temperature °C. | 1400 | 1600 | 1700 | 1790 |
|---|---|---|---|---|
| Apparent specific gravity | 3.81 | 3.83 | 3.83 | 3.83 |
| Bulk specific gravity | 2.67 | 3.23 | 3.54 | 3.63 |
| Porosity % | 29.9 | 15.6 | 7.6 | 5.1 |
| Interparticle voidage % | 46.3 | 46.0 | 45.8 | 46.1 |
| Particle compressive strength kgf (1) | 1.9 | 8.0 | 13.5 | 28.0 |
| Sphericity (2) | 0.97 | 0.97 | 0.96 | 0.97 |

Remarks:
(1) Compressive force when a sphere particle of about 1 mm in diameter is just broken between two parallel plates.
(2) Value indicating uniformity of sphericity assuming interparticle voidage of ideal sphere is 47.6%. Size distribution of particles incurs value less than unity.

TABLE 2

Effect of heat-hardening temperature on the non-spherized but heat-hardened particles (composition of the high-alumina material is the same as in Table 1; equivalent diameter of particles, 1.0 to 1.17 mm)

| Heat-hardening temperature °C. | 1400 | 1600 | 1700 | 1790 |
|---|---|---|---|---|
| Apparent specific gravity | 3.83 | 3.82 | 3.83 | 3.82 |
| Bulk specific gravity | 2.59 | 3.06 | 3.44 | 3.51 |
| Porosity % | 32.4 | 19.8 | 10.1 | 8.0 |
| Interparticle voidage % | 54.6 | 54.2 | 53.6 | 53.4 |
| Particle compressive strength kgf (1) | 0.8 | 6.3 | 9.7 | 19.8 |
| Sphericity (2) | 1.15 | 1.14 | 1.13 | 1.12 |

Remarks: See for (1) and (2) the footnotes to Table 1.

TABLE 3

Properties of thermo-spherized particles of high-alumina refractory material having different chemical compositions (heat-hardened at 1750° C.)

| Chemical composition | | | | |
|---|---|---|---|---|
| $Al_2O_3$ | 92.21 | 85.44 | 81.05 | 75.17 |
| $SiO_2$ | 5.52 | 11.33 | 16.75 | 22.63 |
| Apparent specific gravity | 3.67 | 3.54 | 3.41 | 3.28 |
| Bulk specific gravity | 3.48 | 3.34 | 3.20 | 2.82 |
| Porosity % | 5.3 | 5.6 | 6.1 | 9.1 |
| Interparticle voidage % | 46.3 | 46.2 | 46.7 | 47.2 |
| Particle compressive strength kgf (1) | 30.5 | 29.6 | 26.3 | 22.2 |
| Sphericity (2) | 0.97 | 0.98 | 0.98 | 0.99 |

Remarks: See for (1) and (2) footnote of Table 1.

TABLE 4

(Thermospherized particles of 90% $Al_2O_3$ and 5% $SiO_2$ is used)

| | Example number | | | | | |
|---|---|---|---|---|---|---|
| | Example 1 | | | Example 2 | | |
| Test piece | Upper | Central | Lower | Upper | Central | Lower |
| Compressive strength kgf/cm$^2$ | 580 | 570 | 575 | 605 | 600 | 600 |
| Number of thermal shocks | 5 | 5 | 5 | 7 | 7 | 7 |

TABLE 5

(Non-spherized but heat-hardened particles of the same composition is used)

| | Example number | | | | | |
|---|---|---|---|---|---|---|
| | Reference Example 1 | | | Reference Example 2 | | |
| Test piece | Upper | Central | Lower | Upper | Central | Lower |
| Compressive strength kgf/cm$^2$ | 425 | 210 | 445 | 440 | 385 | 390 |
| Number of thermal shocks | 3 | 1 | 3 | 4 | 3 | 4 |

TABLE 6

(Particles of 82% $Al_2O_3$ and 10% $SiO_2$ are used)

| | Example number | | | | | |
|---|---|---|---|---|---|---|
| | Example 3 | | | Reference Example 3 | | |
| Test piece | Upper | Central | Lower | Upper | Central | Lower |
| Compressive strength kgf/cm$^2$ | 570 | 555 | 575 | 420 | 205 | 450 |
| Number of thermal shocks | 6 | 6 | 6 | 4 | 2 | 4 |

TABLE 7

(Thermospherized particles and nonspherized but heat-hardened particles are used)

| Example number | Example 4 | | |
|---|---|---|---|
| Test piece | Upper | Central | Lower |
| Compressive strength kgf/cm$^2$ | 540 | 510 | 530 |
| Number of thermal shocks | 5 | 5 | 5 |

What is claimed is:

1. Refractory nozzles for use in steel-making apparatus and for conveying molten steel, said nozzles comprising: a tubular structure having as primary constituents from 70% to 92% by weight high-alumina refractory materials containing greater than 81% by weight alumina and less than 19% by weight silica; 5% to 20% by weight graphite powder; and 3% to 15% by weight silica powder with minor amounts of additives; wherein a major part of said high-alumina refractory material has been thermospherized to provide substantially spherical particles having 0.3 to 3.0 mm diameter and being greater than 10 kgf in particle compressive strength.

2. Refractory nozzles as claimed in claim 1, wherein said refractory nozzles are shape-formed by the use of a unidirectional compaction press.

3. Refractory nozzles as claimed in claim 1, wherein said refractory nozzles are shape-formed by the use of an isostatic press.

4. Refractory nozzles as claimed in claim 1, wherein said thermospherized particles are made from powder of said high-alumina refractory material having a diameter of less than 50 microns.

5. Refractory nozzles as claimed in claim 1, wherein the size distribution of said thermospherized particles is approximately represented by the Andreasen equation $$F=(D/D_{max})^q\times 100$$

wherein

F = Percent undersize from the cut diameter D $D_{max}$ = Maximum particle diameter, which should be less than one tenth of the nozzle thickness q = Exponential parameter indicating mode of distribution having a value from 0.3 to 0.6.

6. A method of making refractory nozzles for use in steel-making apparatus and for conveying molten steel, said nozzles comprising: a tubular structure having as primary constituents from 70% to 92% by weight high-alumina refractory materials containing greater than 81% by weight alumina and less than 19% by weight silica; 5% to 20% by weight graphite powder; and 3% to 15% by weight silica powder with minor amounts of additives; said method comprising thermospherizing a major part of said high-alumina refractory material to provide substantially spherical particles having 0.3 to 3.0 mm diameter and being greater than 10 kgf in particle compressive strength.

7. The method as defined by claim 6 comprising shape-forming said nozzles with an isostatic press.

8. The method as defined by claim 6 comprising shape-forming said nozzles with a uni-directional compaction press.

9. The method as defined by claim 6 comprising thermospherizing of said high-alumina refractory material having a diameter of less than 50 microns.

10. The method as defined by claim 6 wherein the size distribution of said thermospherized particles is approximately represented by the Andreasen equation $$F=(D/D_{max})^q\times 100$$

wherein

F = Percent undersize from the cut diameter D $D_{max}$ = Maximum particle diameter which should be less than one tenth of the nozzle thickness q = Exponential parameter indicating mode of distribution having a value from 0.3 to 0.6.

11. The method as defined by claim 6 comprising forming said nozzle without after-burning.

* * * * *